US006982500B2

(12) United States Patent
Zhang et al.

(10) Patent No.: US 6,982,500 B2
(45) Date of Patent: Jan. 3, 2006

(54) POWER-DOWN SCHEME FOR AN ON-DIE VOLTAGE DIFFERENTIATOR DESIGN

(75) Inventors: Kevin X. Zhang, Portland, OR (US); Liqiong Wei, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 465 days.

(21) Appl. No.: 10/095,864

(22) Filed: Mar. 11, 2002

(65) Prior Publication Data

US 2003/0168914 A1 Sep. 11, 2003

(51) Int. Cl.
*H01H 3/26* (2006.01)

(52) U.S. Cl. ..... 307/140; 307/64; 713/323

(58) Field of Classification Search ..... 307/24, 307/18, 140, 64
See application file for complete search history.

(56) References Cited

U.S. PATENT DOCUMENTS 5,272,677 A 12/1993 Yamamura
5,796,334 A * 8/1998 Chen et al. ..... 340/539.3
6,078,539 A * 6/2000 Dvir ..... 365/226
6,308,312 B1 10/2001 Houston
RE37,708 E * 5/2002 Danstrom ..... 323/284
6,683,767 B2 * 1/2004 Ito et al. ..... 361/56
6,715,090 B1 * 3/2004 Totsuka et al. ..... 713/323
2001/0054760 A1 12/2001 Ito et al.
2004/0012397 A1 * 1/2004 Mizuno et al. ..... 324/522

FOREIGN PATENT DOCUMENTS

WO WO 01/53916 A2 7/2001

OTHER PUBLICATIONS

PCT Search Report, PCT/US03/04519, mailed Jun. 28, 2004.
PCT Written Opinion, PCT/US03/04519, mailed Apr. 28, 2004.

* cited by examiner

*Primary Examiner*—Robert L. DeBeradinis
(74) *Attorney, Agent, or Firm*—Blakely, Sokoloff, Taylor & Zafman LLP

(57) ABSTRACT

According to one embodiment, an integrated circuit is disclosed. The integrated circuit includes a plurality of circuit blocks. Each circuit block includes a voltage differentiator that generates a local supply for the circuit block.

17 Claims, 3 Drawing Sheets

POWER-DOWN SCHEME FOR AN ON-DIE VOLTAGE DIFFERENTIATOR DESIGN

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The present invention relates to integrated circuits; more particularly, the present invention relates to generating multiple power supply voltages on an integrated circuit.

BACKGROUND

Recently, power consumption has become an important concern for high performance computer systems. Consequently, low power designs have become significant for present-day very large scale integration (VLSI) systems. The most effective way to reduce power dissipation in an integrated circuit (IC) is by decreasing the power supply voltage ($V_{CC}$) at the IC.

In order to simultaneously achieve high performance and low power, multi-$V_{CC}$ design, various techniques have been developed. However, due to the high cost of packaging and routing, it is typically difficult to generate multi-$V_{CC}$ designs using traditional off-chip voltage regulators.

BRIEF DESCRIPTION OF THE DRAWINGS

The present invention will be understood more fully from the detailed description given below and from the accompanying drawings of various embodiments of the invention. The drawings, however, should not be taken to limit the invention to the specific embodiments, but are for explanation and understanding only.

DETAILED DESCRIPTION

A mechanism to power down one or more circuit blocks on an integrated circuit (IC) using on-die voltage differentiators is described. In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
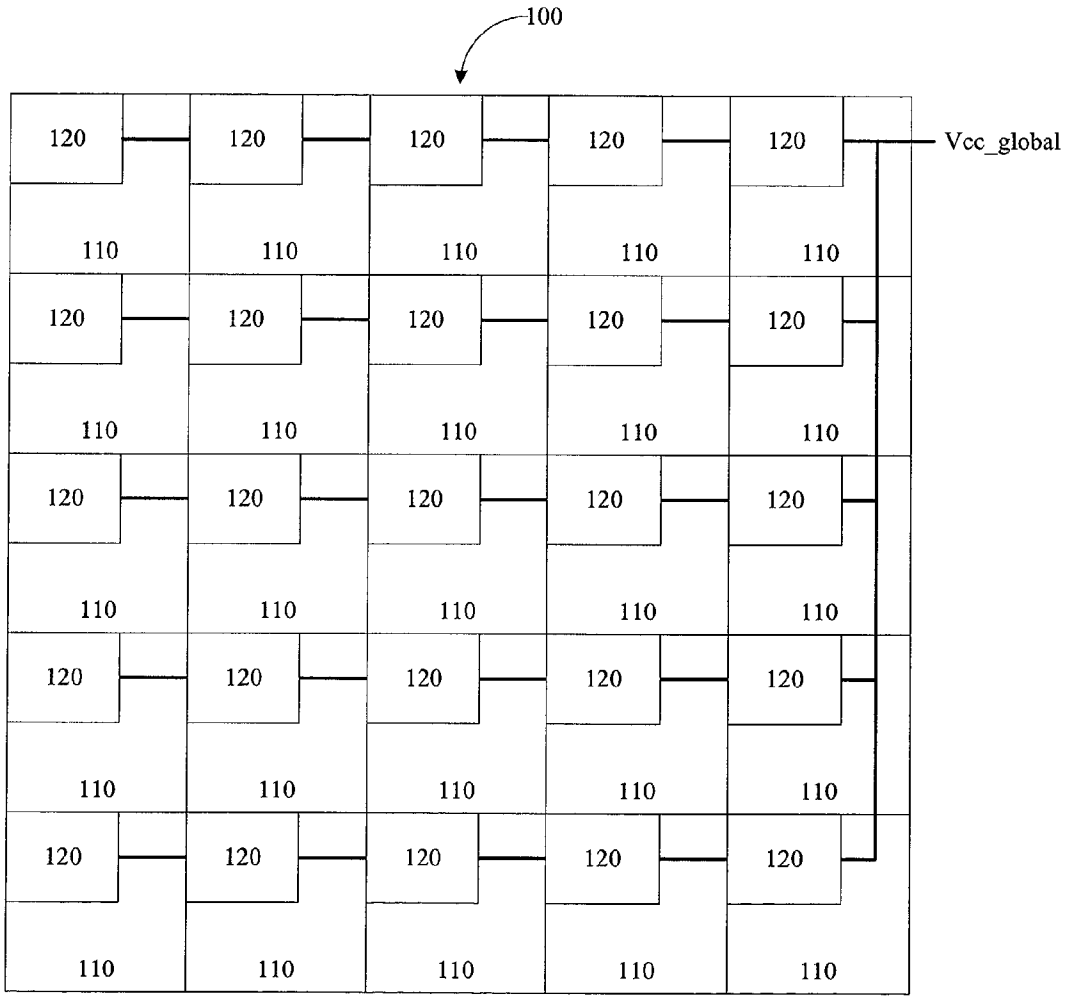
FIG. 1 is a block diagram of one embodiment of an integrated circuit.

FIG. 1 is a block diagram of one embodiment of an IC 100. According to one embodiment, IC 100 is partitioned into twenty-five circuit blocks 110. In a further embodiment, each circuit block 110 includes a voltage differentiator 120. Each voltage differentiator 120 generates a local power supply ($V_{CC}$_local) from an external power supply ($V_{CC}$_global). In one embodiment, differentiator 120 switches off $V_{CC}$_local whenever the particular circuit block 110 in which the differentiator 120 is included is operating in a standby state. One of ordinary skill in the art will appreciate that other quantities of circuit blocks 110 may be implemented within IC 100.

Figure 2:
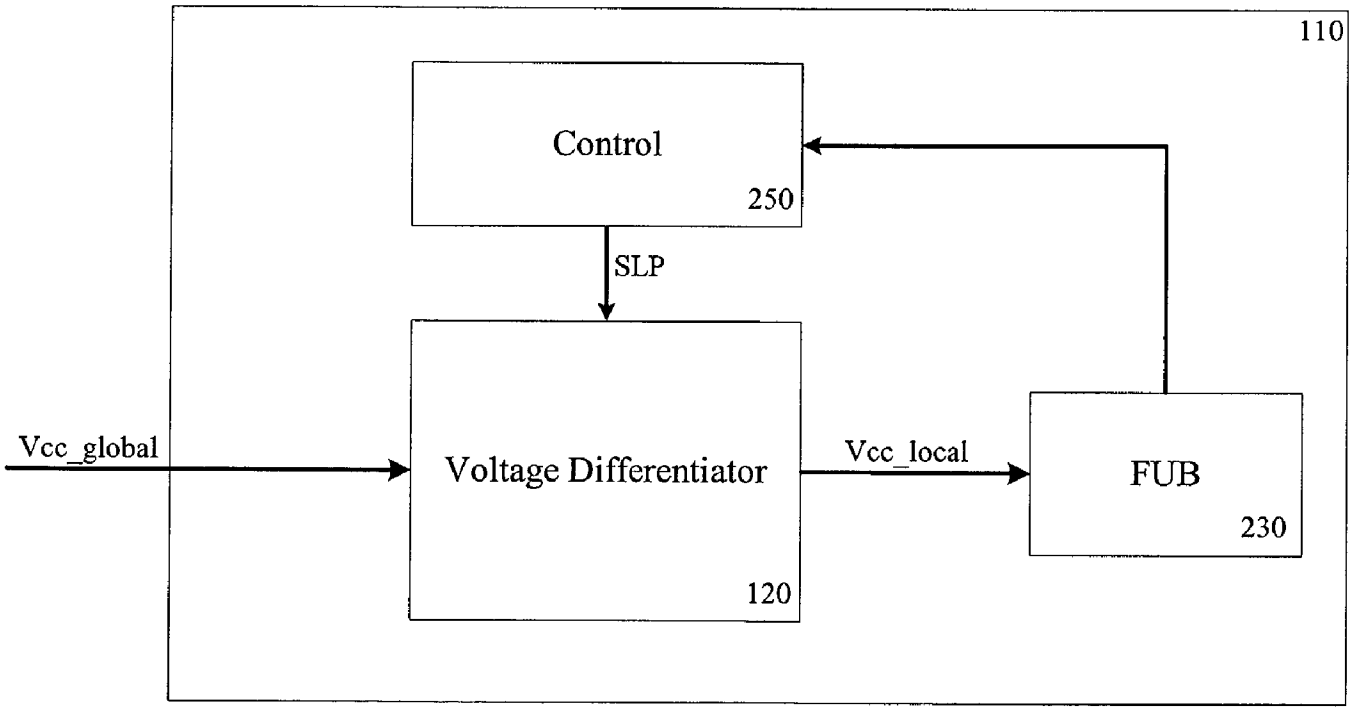
FIG. 2 is a block diagram of one embodiment of a circuit block.

FIG. 2 is a block diagram of one embodiment of a circuit block 110. Circuit block 110 includes voltage differentiator 120, a functional unit block (FUB) 230 and a control module 250. FUB 230 is coupled to voltage differentiator 120. In one embodiment, FUB 230 is logic circuitry that may encompass various components within IC 100 (e.g., microprocessor logic, microcontroller logic, memory logic, etc.). FUB 230 is powered by $V_{CC}$_local received from voltage differentiator 120.

Control module 250 is coupled to voltage differentiator 120 and FUB 230. Control module determines the operation mode for circuit block 110 based upon the status of FUB 230 circuitry. According to one embodiment, control module 250 transmits a standby signal (SLP) to voltage differentiator 120. SLP is used to indicate whether FUB 230 is currently in an operating mode, or in a standby mode.

If FUB 230 is in an operating mode, control module 250 transmits a high logic level (e.g., logic 1) to voltage differentiator 120, indicating that $V_{CC}$_local is to be generated and forwarded to FUB 230. If, however, FUB 230 is idle, control module 250 transmits a low logic level (e.g., logic 0) to voltage differentiator 120, indicating that FUB 230 is to be powered down. Thus, $V_{CC}$_local is not generated, and power is conserved.

Figure 3:
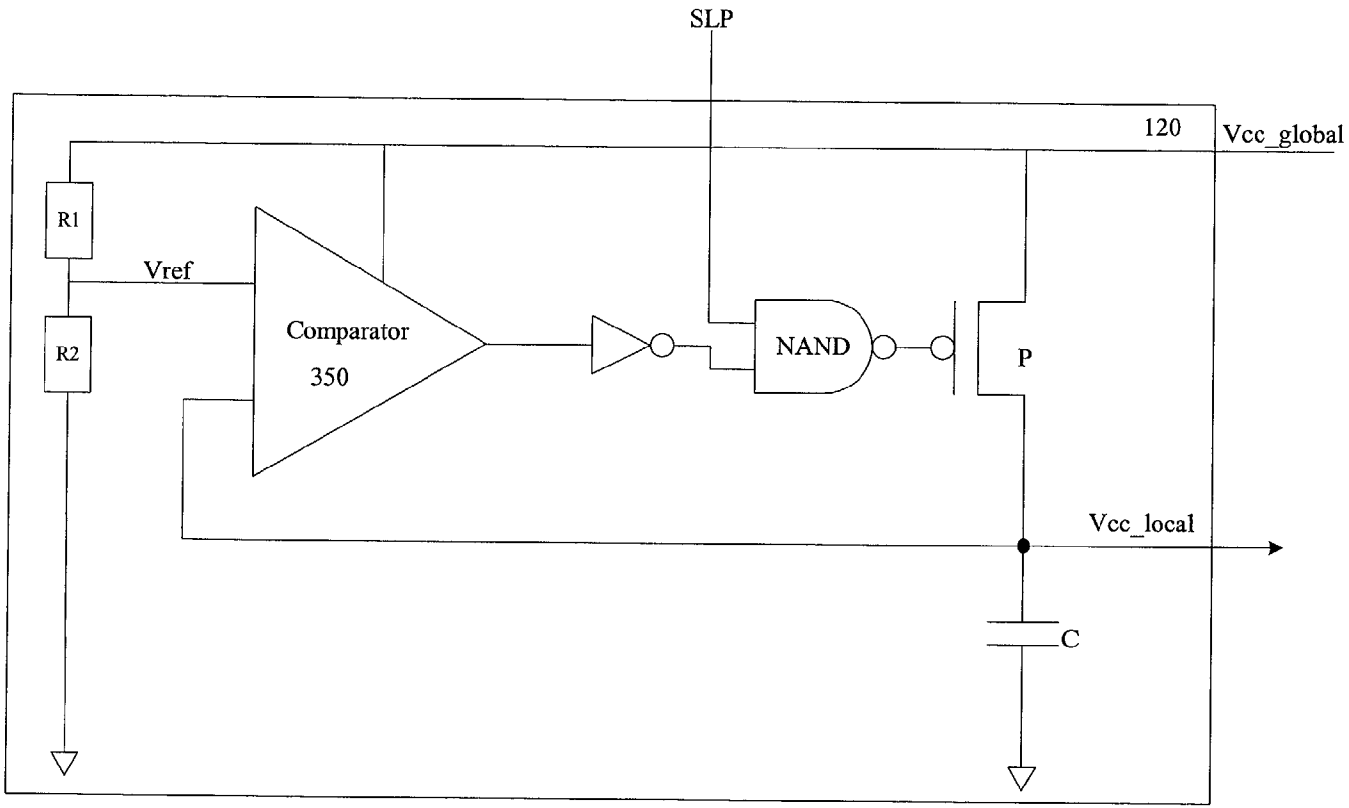
FIG. 3 illustrates one embodiment of a voltage differentiator.

FIG. 3 illustrates one embodiment of voltage differentiator 120. Voltage differentiator 120 includes resistors R1 and R2 a comparator 350, an inverter, a not-and (NAND) gate, a PMOS transistor (P) and a capacitor. Resistors R1 and R2 are used to generate a reference voltage ($V_{REF}$) for comparator 350. The reference voltage is specified by the equation $V_{REF}$=R2* $V_{CC}$/(R1+R2). In one embodiment, $V_{REF}$ may be tuned to a desired voltage at each circuit block 110 by changing the resistance values of resistors R1 and R2.

$V_{REF}$ is received at one input of comparator 350. Comparator 350 receives a feedback of $V_{CC}$_local from transistor P at its second input. Comparator 350 compares $V_{REF}$ to $V_{CC}$_local. If $V_{CC}$_local falls below $V_{REF}$, the output of comparator 350 is activated at logic 0. According to one embodiment, comparator 350 is an operational amplifier. However, one of ordinary skill in the art will recognize that other comparison logic circuitry may be used to implement comparator 350.

The inverter is coupled to the output of comparator 350 and inverts the output value received from comparator 350. The output of the inverter is coupled to one input of the NAND gate. The NAND gate receives the SLP signal at its second input. Whenever the output of the NAND gate and the SLP signal are both at logic 1, the NAND gate is activated to logic 0. In other embodiments, the inverter may not be included within voltage differentiator 120. In such embodiments, the NAND gate may be replaced with an and-gate.

The gate of transistor P is coupled to the output of the NAND gate. The source of transistor P is coupled to $V_{CC}$_global, while the drain is coupled to an input of comparator 350, the capacitor and FUB 230. Transistor P is activated whenever the NAND gate is activated to logic 0.

During the FUB 230 operating mode (e.g., SLP=logic 1), transistor P is activated whenever $V_{CC}$_local falls below $V_{REF}$. In particular, comparator 350 senses such a condition and is activated to logic 0. The inverter inverts the logic 0 signal into a logic 1. Thus, the NAND gate is activated to logic 0, activating the gate of transistor P. Transistor P charges the decouple capacitor, increasing $V_{CC}$_local. If $V_{CC}$_local is greater than $V_{REF}$, transistor P is turned off. Consequently, $V_{CC}$_local is always close to $V_{REF}$.

During the standby mode, the NAND gate is deactivated because of the received SLP value of logic 0. Accordingly, transistor P is turned off. $V_{CC}$_local will drop and leakage power attributed to circuit block 110 is significantly reduced.

The use of on-die voltage differentiators enables the generation of a local power supply voltage for each circuit block within an IC, which reduces the power dissipation. Moreover, the power down (or standby) control mechanism, combined with the on-die voltage differentiators drastically reduces leakage power during idle time for a circuit block.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as the invention.

What is claimed is:

1. An integrated circuit comprising:

a first circuit block having:

a first voltage differentiator to receive an external power supply and to provide a first power supply for the first circuit block; and a first control module, coupled to the first voltage differentiator, to determine the operation mode for the first circuit block, to supply the first power supply to the first circuit block if the circuit block is operating in a normal power mode and to switch off the first power supply if the first circuit block is operating in a standby mode; and a second circuit block having:

a second voltage differentiator to receive the external power supply and to provide a second power supply for the second circuit block; and a second control module, coupled to the second voltage differentiator, to determine the operation mode for the second circuit block, to supply the second power supply to the second circuit block if the circuit block is operating in a normal power mode and to switch off the second power supply if the second circuit block is operating in a standby mode.

2. The integrated circuit of claim 1 wherein the first circuit block further comprises a functional unit block (FUB) coupled to the first control module and the first voltage differentiator to receive the first power supply.

3. The integrated circuit of claim 2 wherein the first control module determines the operating mode of the first circuit block based upon the status of the first FUB.

4. The system of claim 2 wherein the first control module determines the operating mode of the first circuit block based upon the status of the first FUB.

5. The integrated circuit of claim 3 wherein the first circuit block operates in the standby mode whenever the PUB is inactive.

6. The integrated circuit of claim 1 wherein the first control module generates a standby signal that is transmitted to the first voltage differentiator to indicate whether the first circuit block is to operate in the normal power mode or the standby mode.

7. The integrated circuit of claim 1 wherein the first voltage differentiator comprises:

a voltage reference generator that generates a reference voltage; and a comparator, coupled to the voltage reference generator, to compare the reference voltage to the local power supply voltage.

8. The integrated circuit of claim 7 wherein the first voltage differentiator further comprises:

an inverter coupled to the output of the comparator;

a NAND gate having a first input coupled to the output of the inverter and a second input coupled to the control module for receiving the standby signal;

a PMOS transistor having a gate coupled to the output of the NAND gate and a drain coupled to the FUB and the comparator; and a capacitor coupled to the drain of the PMOS transistor.

9. The integrated circuit of claim 7 wherein the comparator comprises an operational amplifier.

10. The integrated circuit of claim 7 wherein the voltage reference generator comprises:

a first resistor coupled to a global voltage power supply and the comparator; and a second resistor coupled to the first resistor, the comparator and ground.

11. The system of claim 1 the first circuit block further comprises a functional unit block (FUB) coupled to the first control module and the first voltage differentiator to receive the first power supply.

12. A system comprising:

a main memory device; and a microprocessor, coupled to the main memory device, including:

a first circuit block having:

a first voltage differentiator to receive an external power supply and to provide a first power supply for the first circuit block; and a first control module, coupled to the first voltage differentiator, to determine the operation mode for the first circuit block, to supply the first power supply to the first circuit block if the circuit block is operating in a normal power mode and to switch off the first power supply if the first circuit block is operating in a standby mode; and a second circuit block having:

a second voltage differentiator to receive the external power supply and to provide a second power supply for the second circuit block; and a second control module, coupled to the second voltage differentiator, to determine the operation mode for the second circuit block, to supply the second power supply to the second circuit block if the circuit block is operating in a normal power mode and to switch off the second power supply if the second circuit block is operating in a standby mode.

13. The system of claim 12 wherein the first control module generates a standby signal that is transmitted to the first voltage differentiator to indicate whether the first circuit block is to operate in the normal power mode or the standby mode.

14. The system of claim 12 wherein the first voltage differentiator comprises:

a voltage reference generator that generates a reference voltage; and a comparator, coupled to the voltage reference generator, to compare the reference voltage to the local power supply voltage.

15. The system of claim 14 wherein the first voltage differentiator further comprises:

an inverter coupled to the output of the comparator;

a NAND gate having a first input coupled to the output of the inverter and a second input coupled to the control module for receiving the standby signal;

a PMOS transistor having a gate coupled to the output of the NAND gate and a drain coupled to the FUB and the comparator; and a capacitor coupled to the drain of the PMOS transistor.

16. The system of claim 14 wherein the comparator comprises an operational amplifier.

17. The system of claim 14 wherein the voltage reference generator comprises:

a first resistor coupled to a global voltage power supply and the comparator; and a second resistor coupled to the first resistor, the comparator and ground.

* * * * *

UNITED STATES PATENT AND TRADEMARK OFFICE

CERTIFICATE OF CORRECTION

PATENT NO. : 6,982,500 B2
APPLICATION NO. : 10/095864
DATED : January 3, 2006
INVENTOR(S) : Zhang et al.

It is certified that error appears in the above-identified patent and that said Letters Patent is hereby corrected as shown below:

In column 4, at line 2, delete “PUB” and insert --FUB--.

Signed and Sealed this

Twentieth Day of January, 2009

JON W. DUDAS
*Director of the United States Patent and Trademark Office*